US008090126B2

(12) United States Patent
Beckinger et al.

(10) Patent No.: US 8,090,126 B2
(45) Date of Patent: Jan. 3, 2012

(54) APPARATUS AND METHOD FOR GENERATING A SPEAKER SIGNAL ON THE BASIS OF A RANDOMLY OCCURRING AUDIO SOURCE

(75) Inventors: Michael Beckinger, Erfurt (DE); René Rodigast, Tautenhain (DE)

(73) Assignee: Fraunhofer-Gesellschaft zur Foerderung der Angewandten Forschung e.V., Munich (DE)

( * ) Notice: Subject to any disclaimer, the term of this patent is extended or adjusted under 35 U.S.C. 154(b) by 1053 days.

(21) Appl. No.: 11/917,556

(22) PCT Filed: Jun. 1, 2006

(86) PCT No.: PCT/EP2006/005233

§ 371 (c)(1),
(2), (4) Date: Dec. 14, 2007

(87) PCT Pub. No.: WO2006/133812

PCT Pub. Date: Dec. 21, 2006

(65) Prior Publication Data

US 2008/0181438 A1 Jul. 31, 2008

(30) Foreign Application Priority Data

Jun. 16, 2005 (DE) ..... 10 2005 027 978

(51) Int. Cl.
*H04R 5/02* (2006.01)

(52) U.S. Cl. ..... 381/312; 84/300

(58) Field of Classification Search ..... 381/310, 381/300, 311

See application file for complete search history.

(56) References Cited

U.S. PATENT DOCUMENTS

| | | | | |
|---|---|---|---|---|
| 6,728,664 | B1 | 4/2004 | Fouad | |
| 7,167,571 | B2 * | 1/2007 | Bantz et al. | 381/312 |
| 2005/0105442 | A1 | 5/2005 | Melchior et al. | |
| 2006/0092854 | A1 | 5/2006 | Roder et al. | |

OTHER PUBLICATIONS

Official communication issued in the International Application No. PCT/EP2006/005233, mailed on Sep. 4, 2006.

Miklavcic: "Computational Real-Time Sound Synthesis of Rain," Proc. of the 7th Int. Conference on Digital Audio Effects, pp. 169-172, Naples, Italy, Oct. 5-8, 2004.

English Translation of the Official Communication issued in counterpart International Application No. PCT/EP2006/005233, mailed on Jan. 24, 2008.

AES Convention Paper "Generation on highly immersive atmospheres for Wave Field Synthesis reproduction", A. Wagner, et al., 116th Convention, May 8-11, 2004, Berlin, Germany.

"Entwicklung eines Systems zur Erstellung immersiver akustischer Atmosphären für die Wiedergabe mittels Klangfeldsynthese", by A. Walther and A. Wagner, Nov. 16, 2004.

William H. Press, et al., "Numerical Receipts in C", 1998, Cambridge University Press. pp. 1-13, 537-545, 558-564.

* cited by examiner

*Primary Examiner* — Kimberly Lockett
(74) *Attorney, Agent, or Firm* — Keating & Bennett, LLP

(57) ABSTRACT

A particle generator for generating a speaker signal for a speaker channel in a multi-channel reproduction environment includes a position generator for providing a plurality of positions where the audio source is to occur, as well as a time generator for providing times of occurrence when the audio source is to occur, a time being associated with a position. Also, an individual pulse response generator for generating individual pulse response information for each position of the plurality of positions is provided. A combination pulse response is formed by a pulse response combiner for combining the individual pulse response information in accordance with the times of occurrence. This overall pulse response is finally used to adjust a filter with which the audio signal is finally filtered.

13 Claims, 5 Drawing Sheets

APPARATUS AND METHOD FOR GENERATING A SPEAKER SIGNAL ON THE BASIS OF A RANDOMLY OCCURRING AUDIO SOURCE

CROSS-REFERENCE TO RELATED APPLICATIONS

This application is a 371 of International Application No. PCT/EP2006/005233, filed Jun. 1, 2006, which designated the United States and was not published in English.

TECHNICAL FIELD

The present invention relates to audio signal processing and in particular to audio signal processing in systems comprising a multitude of speakers, such as wave field synthesis systems.

BACKGROUND

FIG. 4 shows a typical wave field synthesis scenario. At the heart of the wave field synthesis system is the wave field synthesis renderer 400 which generates a specific speaker signal for each of the individual speakers 401 grouped around a reproduction environment. Specifically, between the wave field synthesis renderer 400 and each speaker, there is thus a speaker channel on which the speaker signal for said respective speaker is transmitted from the wave field synthesis renderer 400. On the input side, the wave field synthesis renderer 400 is supplied with control data typically arranged within a control file 402. The control file may include a list of audio objects, each audio object having a virtual position and an audio signal associated with it. The virtual position is the position that a listener who is in the reproduction environment will localize.

If, e.g., a movie screen is located in the reproduction environment, what is generated for the viewer is not only an optical spatial scenario, but also a tonal spatial scenario. For this purpose, all speaker channels are supplied with speaker signals which are derived from the same audio signal for a source, such as an actor or, e.g., an approaching train. However, all of these speaker signals differ to a greater or lesser extent in terms of their scaling and their delay of the input signal. The scaling and the delay for the individual speaker signals are generated by the wave field synthesis algorithm which operates in accordance with the Hugyen principle. As is known, the principle is based on that any wave form may be generated by means of a large number of spherical waves. In that the individual speakers which provide the individual "spherical waves" are controlled with the same signal, but such that it has a different scaling and a different delay applied to it, one will get the impression, if one is in the reproduction environment, of a single sound source which is now located at the virtual position.

If there are several audio sources simultaneously occurring at any one time, but at different virtual positions, the wave field synthesis renderer will perform the above-described procedure for each single audio object, and will then perform a summation of the individual component signals before the speaker signals are transmitted to the individual speakers via the speaker channels. When contemplating speaker 403, for example, which is located at a specific speaker position which is known, the wave field synthesis renderer will generate, for each audio object, a component signal which is to be reproduced by the speaker 403. Subsequently, once all component signals for one point in time have been calculated for the speaker 403, the individual component signals are simply added up to obtain the common, or combined, component signal for the speaker channel extending from the wave field synthesis renderer 400 to the speaker 403. However, if only one source is active for the speaker 403 at any one time, the summation may naturally be dispensed with.

Typically, the wave field synthesis renderer 400 has practical limitations. Given the fact that the entire wave field synthesis concept necessitates a relatively large amount of computing time anyhow, the wave field synthesis renderer 400 will only be able to process a specific number of individual sources simultaneously. A typical maximum number of sources to be processed simultaneously is 32 sources. This number of 32 sources is sufficient for typical scenes, for example dialogs. However, this number is far too small if there are certain events occurring, such as a sound of rain, which is composed of a very large number of individual different sound events. An individual sound event namely is the sound generated by a raindrop when it falls onto a specific surface.

It may be readily seen that 32 raindrops will not create a realistic sound of rain if the 32 raindrops were modeled as individual audio sources in a localized manner.

With such random processes which include many sources of sound which cannot be processed individually, an overall sound of rain has therefore been created and, for example, evenly mixed into all speaker channels. However, this results in that the listening experience is reduced by the fact that, unlike the background of other sounds, which may be perceived in a spatially localized manner, this is not the case with the sound of rain.

In the AES Convention Paper "Generation of highly immersive atmospheres for Wave Field Synthesis reproduction", A. Wagner, et al., 116$^{th}$ Convention, 8-11 May, Berlin, Germany, and in a similar dissertation submitted for a diploma entitled "Entwicklung eines Systems zur Erstellung immersiver akustischer Atmosphären für die Wiedergabe mittels Klangfeldsynthese", by A. Walther and A. Wagner, 16 Nov. 2004, immersive atmospheres are generated using sounds which are recorded with special microphone assemblies.

The specialist publication "Computational Real-Time Sound Synthesis of Rain", S. J. Miklavcic et.al., Proceedings of the Seventh International Conference on Digital Audio Effects (DAFx '04), Naples, Italy, 5 to 8 Oct. 2004, refers to the real-time sound synthesis for computer games with the use of a physical model of the impingement of raindrops on solid surfaces or on water. For a multi-speaker sound reproduction of a system comprising five speakers, two of which are positioned behind the listener, two of which are positioned in front of the listener, and of which one speaker is positioned in the center in front of the listener, a zone of impingement of a raindrop, which is symmetrically positioned around the listener, is divided up into sectors of a circle which are defined in accordance with the speakers. Using a random distribution function, a drop impingement is simulated in that the sector of the impingement is determined. Subsequently, the sound pressure of the impingement is divided up among the two neighboring speakers, and on this basis, a sound signal is generated for these two speakers.

What is disadvantageous about this concept is that, even with this concept, it is not possible to create any particle positions, but it is only possible to use directions with regard to a listener by means of stereo panning between two speakers which are adjacent to the impingement position of the drop. Again, no ideal sound of rain is created for the listener.

SUMMARY

According to an embodiment, an apparatus for generating a speaker signal for a speaker channel associated with a speaker which may be mounted, in a reproduction environment, at a speaker position of a plurality of speaker positions may have: a source for providing an audio signal for an audio source which is to occur at different positions and at different times within an audio scene; a position generator for providing a plurality of positions where the audio source is to occur; a time generator for providing times of occurrence when the audio source is to occur, a time being associated with a position; an individual pulse response generator for generating individual pulse response information for each position of the plurality of positions for a speaker channel on the basis of the positions and information on the speaker channel; a pulse response combiner for combining the individual pulse response information in accordance with the times of occurrence to acquire combination pulse response information for the speaker channel; and a filter for filtering the audio signal using the combination pulse response information to acquire a speaker signal for the speaker channel, which signal represents the audio source which occurs at different positions and at different times within the audio scene.

According to another embodiment, a method for generating a speaker signal for a speaker channel associated with a speaker which may be mounted, in a reproduction environment, at a speaker position of a plurality of speaker positions may have the steps of: providing an audio signal for an audio source which is to occur at different positions and at different times within an audio scene; providing a plurality of positions where the audio source is to occur; providing times of occurrence when the audio source is to occur, a time being associated with a position; generating individual pulse response information for each position of the plurality of positions for a speaker channel on the basis of the positions and information on the speaker channel; combining the individual pulse response information in accordance with the times of occurrence to acquire combination pulse response information for the speaker channel; and filtering the audio signal using the combination pulse response information to acquire a speaker signal for the speaker channel, which signal represents the audio source which occurs at different positions and at different times within the audio scene.

Another embodiment may have a computer program having a program code for performing the method for generating a speaker signal for a speaker channel associated with a speaker which may be mounted, in a reproduction environment, at a speaker position of a plurality of speaker positions, wherein the method may have the steps of: providing an audio signal for an audio source which is to occur at different positions and at different times within an audio scene; providing a plurality of positions where the audio source is to occur; providing times of occurrence when the audio source is to occur, a time being associated with a position; generating individual pulse response information for each position of the plurality of positions for a speaker channel on the basis of the positions and information on the speaker channel; combining the individual pulse response information in accordance with the times of occurrence to acquire combination pulse response information for the speaker channel; and filtering the audio signal using the combination pulse response information to acquire a speaker signal for the speaker channel, which signal represents the audio source which occurs at different positions and at different times within the audio scene, when the computer program runs on a computer.

The present invention is based on the findings that both the position and the time at which an audio source is to occur in an audio scene may be created synthetically. In accordance with the invention, depending on such synthetically created positions and times, an individual pulse response is generated for each position. In particular, the individual pulse response reproduces the imaging of the audio source, arranged at a specific position, to a speaker, or a speaker signal. Subsequently, the individual items of individual pulse response information is combined in a time-correct manner, i.e. depending on the times of occurrence associated with the positions of occurrence, so as to obtain combination pulse response information for a speaker channel. Thereupon, the audio signal describing the audio source is filtered using the combination pulse response information so as to eventually obtain the speaker signal for the speaker channel, this speaker signal representing the audio source.

Unlike the audio signal which directly represents the audio source, i.e. which is a recording of such an individual event, for example of an impinging raindrop, the speaker signal for the speaker channel represents the overall signal which exists due to the audio signal which has repeatedly occurred at specific times, the individual events of the occurrence of the raindrop being unambiguously localized, within the reproduction space, by determined virtual positions.

Therefore, a realistic background of rain is created within the reproduction space, of which the user thinks that it is not only occurring somewhere in the distance on the screen or behind the screen, but of which the listener has the impression that he/she is "out in the rain" in the true sense of the word.

By contrast to what has been known so far, where pulse responses are typically stationary or can only be changed very slowly, whereas the audio signal filtered through a filter which is determined by the pulse response is highly variable, it is exactly the other path that is taken in accordance with the invention. For example, only a single, typically very short, audio signal is taken which is filtered through a filter which is described by a typically very long pulse response which changes very much in terms of time. Thus, a filter is created which will have significant pulse response values even with very large delays, since these values will eventually determine, for example, an impingement of a raindrop which occurs at a specific late(r) point in time.

What is thus achieved, in accordance with the invention, is that, in particular for large spaces, an enveloping effect is achieved by means of randomly occurring particles, i.e., for example, transient sound sources such as raindrops. Without any hardware limitations of a wave field synthesis renderer, which can only render, e.g., 32 channels at any one time, any frequency desired of the individual sound objects, such as raindrops, may be created in accordance with the invention.

In accordance with the invention, spatially distributed particles may therefore be reproduced at a high repetition rate, and, for large spaces, in real time. Thus, in accordance with the invention, sound sources may occur at different points in the room simultaneously, and may be simulated simultaneously. In particular for large rooms having a high level of occupancy of sound sources, a large number of input channels is needed in accordance with the invention, since the signals are generated within the wave field synthesis renderer on the basis of the individual sources. For example, for any large number of raindrops, one single audio object, which includes the audio signal of the raindrop, will be sufficient. The number of raindrops located at different virtual positions and occurring more or less simultaneously is expressed only by the number of individual pulse responses that are generated and combined.

However, since the generation of the individual pulse responses may be configured to be efficient in terms of computing time, just like the combination of the individual pulse responses, the inventive concept leads to a considerable reduction in computing time as compared to the case where, for each audio object, a specific virtual source is supplied, for example via a control file, to a wave field synthesis renderer at a specific virtual position. On account of the inventive combination of the individual pulse responses, an arbitrarily large number of raindrops at different positions will not lead to a correspondingly large number of convolutions, but will lead to only one single convolution of a (large) pulse response with the audio signal which represents the audio source (the raindrop). This, too, is a reason why the inventive concept may be executed in a very efficient manner in terms of computing time.

In accordance with the invention, any primary sound source is reproduced in a virtual manner via wave field synthesis across an audio sensation area of any size by means of a novel algorithm. The amount of computing power needed is many times smaller than with current wave field synthesis algorithms.

Advantageously, a generation of parameters such as the mean particle density per time, the two-dimensional position within the room, the three-dimensional position within the room, individual filtering of each particle by means of a pulse response is conducted by means of a random number generator. The inventive concept may also be favorably employed for X.Y. multi-channel surround format.

In addition, it is advantageous, using the pulse response, to change, e.g., the sound of the particle, for example raindrop, or to simulate a physical property, for example the raindrop falling onto a piece of wood or onto a metal sheet, which naturally results in different sounds.

BRIEF DESCRIPTION OF THE DRAWINGS

Embodiments of the present invention will be detailed subsequently referring to the appended drawings, in which.

DETAILED DESCRIPTION

Figure 1:
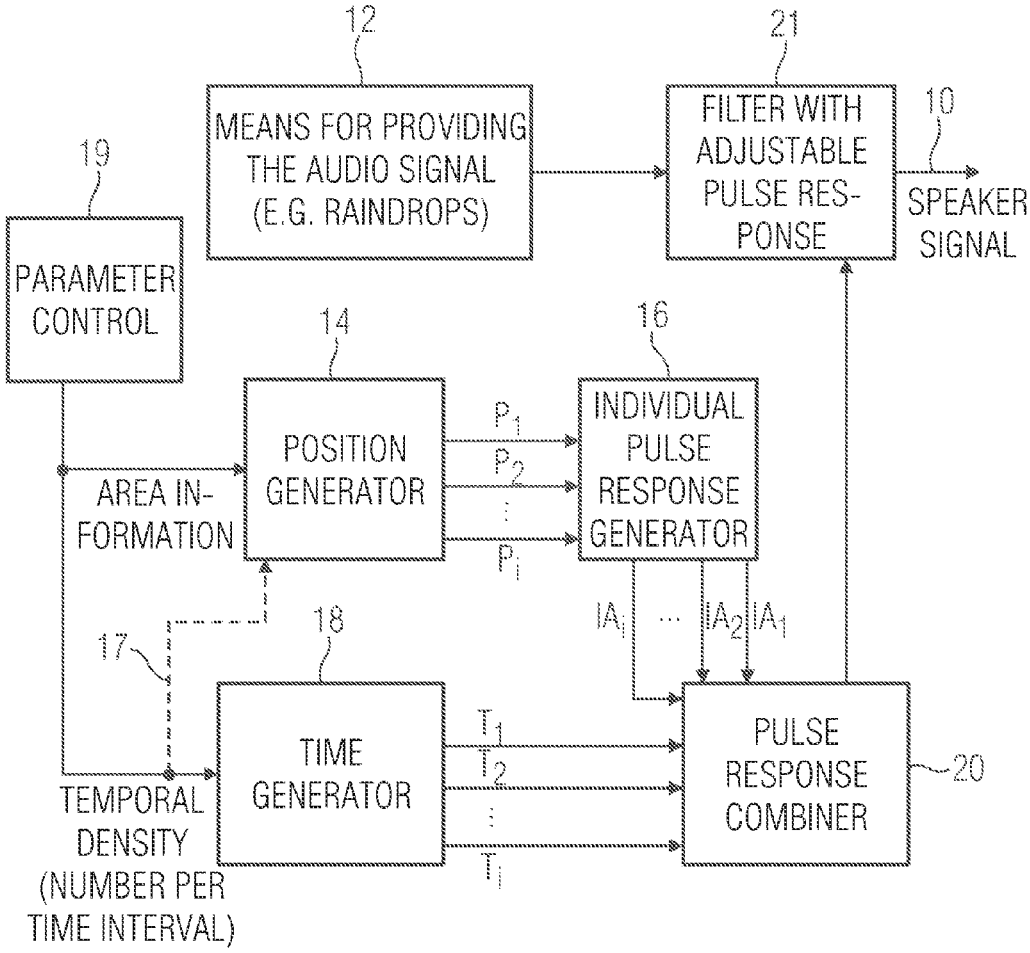
FIG. 1 shows a schematic block diagram of the inventive concept.

FIG. 1 shows an overview diagram of an inventive apparatus for generating a speaker signal at an output 10 for a speaker channel associated with a speaker (such as 403) which may be mounted in a reproduction environment at a speaker position of a plurality of speaker positions. Specifically, the advantageous embodiment of the inventive apparatus shown in FIG. 1 includes a means 12 for providing an audio signal for an audio source which is to occur at different positions and at different times in an audio scene. The means for providing the audio signal is typically a storage medium having an audio signals stored thereon which, for example, represents an impinging raindrop or a sound of a different particle, such as an approaching or disappearing spaceship, for example for a space computer game, a hoofbeat of a horse or a cow or bull in a herd of horses/cattle, etc. In accordance with the invention, this audio signal for the audio source is fixedly stored once, advantageously within the wave field synthesis renderer, for example of a renderer 400 of FIG. 4, and therefore need not be supplied via the control file. Naturally, the audio signal may also be supplied to the renderer via the control file. In this case, the means 12 for providing the audio signal would be a control file along with associated read-out/transmission means.

The inventive apparatus further comprises a position generator for providing a plurality of positions where the audio source is to occur. The position generator 14 is configured to generate, when contemplating FIG. 4, virtual positions which may be located within or outside the reproduction environment. Assuming that a screen, for example, is located at the upper end of the reproduction environment in FIG. 4, onto which screen a film is projected, the virtual positions may evidently also be located behind the screen or in front of the screen.

Depending on the implementation, the position generator 14 may be configured to provide any (x, y) positions within or outside the reproduction environment. Depending on the implementation of the speaker array, alternatively or additionally, a z position component may also be generated, i.e. referring to the question whether the listener is to localize a source above himself/herself or possibly even underneath himself/herself. Also, the position generator is configured to provide random positions within the reproduction environment or outside the reproduction environment, or only positions within a specific grid, depending on the implementation of an individual pulse response generator 16 described below. The generation of positions only within a specific grid will be advantageous if a lookup table is employed in the individual pulse response generator 16 to be described below so as to generate at least a part of or even the entire individual pulse response. However, if continuous position generation is conducted by the position generator 14, a position rounding to the grid may take place either at the output of the position generator 14 or at the input of the individual pulse response generator 16. Alternatively, positions resolved to any fineness desired may be processed by the individual pulse response generator so as to calculate the individual pulse responses without any further position rounding/quantization operations. On the input side, the position generator 14 obtains area information or volume information for the three-dimensional case which indicate the region where positions are to be generated. In other words, the area information defines an area within which rain is to fall, said area typically being perpendicular to the screen. For example, there might be a desire to simulate rain such that the front half of the reproduction environment, i.e. the front half of listeners, is located underneath a tin roof, whereas the rear half of listeners is actually positioned "in the rain". For this purpose, the position generator would be able to generate positions in the entire reproduction environment, since it is raining in the entire reproduction environment. However, if the requirement is such that rain is to occur only in the front half of the reproduction environment, whereas for some reason no rain is supposed to fall in the rear half, the position generator 14 would be controlled by the area information so as to generate virtual positions x, y only in the front half, where it is supposed to be raining.

The inventive apparatus further comprises a time generator 18 for providing times of occurrence at which the audio source is to occur, a time being associated with a position generated by the position generator 14. Thus, mutually associated pairs Pi, Ti exist, Pi representing a position having the number i, whereas Ti represents a time having the number i at which the position Pi is to be active. Advantageously, the time generator 18 is controlled by a density parameter which is provided by a parameter control 19, just like the area information for the position generator 14. The time generator 18 thus obtains, as parameters, the temporal density, i.e. the number of events of occurrence of the audio source per time interval. In other words, the temporal density controls, for a time interval of e.g. 10 seconds, the quantity of raindrops to occur per second, namely, for example, 1,000 raindrops. A lower temporal density leads to fewer drops, whereas a higher temporal density leads to more drops per fixed time interval. The time generator 18 is configured to provide, within such a time interval, the times $T_i$ predefined by the temporal density. As is represented by a dashed line 17, it is also advantageous to supply the temporal density information not only to the time generator 18, but also to the position generator 14, so that the position generator will "outputs" the amount of positions needed which can then have the times, generated by the time generator 18, associated with them. However, it is not absolutely necessary for the density information to be supplied to the position generator. This may be dispensed with if the position generator is sufficiently fast at outputting positions and latching these positions so that they may be supplied to the individual pulse response generator 16 as needed, i.e. in association with moments in time, or controlled by the temporal density information.

Generally, the individual pulse response generator 16 is configured to generate individual pulse response information for each position of the plurality of positions for a speaker channel. In particular, the individual pulse response generator operates on the basis of the position and on the basis of information about the speaker channel in question. Thus, it is evident that the speaker signal for the bottom left speaker of the scenario in FIG. 4 will look different than for the top-right speaker of the scenario in FIG. 4. Moreover, the individual pulse response generator 16 will also be configured to take into account the position information generated by the position generator. The individual pulse response generator will thus calculate the "proportion" exhibited by a specific speaker of the many speakers which determine the reproduction environment of FIG. 4, and express it as a pulse response, such that when all speakers "are playing" at the same time, a user will have the impression that a raindrop has impinged on a specific surface at the position x, y generated by the position generator.

The inventive apparatus further includes a pulse response combiner for combining the individual pulse response information in accordance with the times of occurrence so as to obtain combination pulse response information for the speaker channel. The pulse response combiner is configured to ensure that many events of occurrence of the audio source have occurred, and that they are combined with each other in a temporally correct manner, i.e. controlled by the time information. The advantageous type of combination is an addition. However, weighted additions/subtractions may also be conducted if specific effects are to be achieved. However, what is advantageous is a simple addition of the individual pulse responses IAi, specifically while taking into account the times of occurrence generated by the time generator 18.

The combination pulse response information generated by the pulse response combiner 20 are eventually supplied, just like the audio signal at the output of means 12, to a filter (or a filter device) 21. The filter 21 is a filter comprising an adjustable pulse response, i.e. comprising an adjustable filter characteristic. While the audio signal at the output of means 12 will typically be short, the combined pulse response output by the pulse response combiner 20 will be relatively long and vary very much. In principle, the combined impulse response may be of any length desired, depending on the amount of time for which the effect generator is running. If it runs, for example, for 30 minutes for rain which lasts for 30 minutes, the length of the combined pulse response will also be in this order of magnitude.

At any rate, what is received at the output of the filter 21 is the speaker signal, which, depending on the audio scene, is already the actual speaker signal played back by the speaker, or which, if additional audio objects are reproduced by this speaker, is a speaker signal which is added up with another speaker signal for this speaker so as to generate an overall speaker signal as will be explained later on with reference to FIG. 3. Thus, the filter 21 is configured to filter the audio signal while using the combination pulse response information so as to obtain that speaker signal for the speaker channel which represents the occurrence of the audio source at the different positions and at the different times for a specific speaker channel.

Figure 2A:
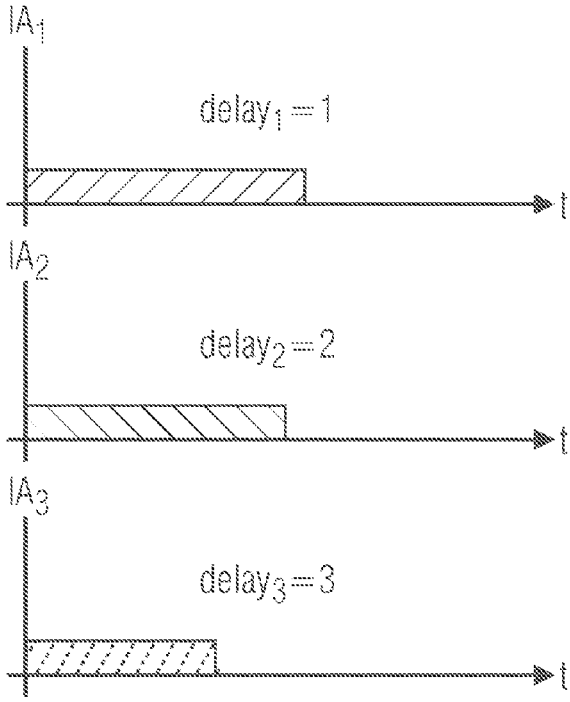
FIG. 2A shows a schematic representation of three different pulse responses for the audio source at different positions and at different times.

Subsequently, the functionality of the pulse response combiner 20 will be depicted with reference to FIGS. 2A to 2C. Three pieces of individual pulse response information IA1, IA2, IA3 are depicted in FIG. 2A by way of example only. Each of the three pulse responses additionally comprises a specific delay, i.e. a temporal delay or a "memory" exhibited by the channel described by this pulse response. The delay of the first pulse response IA1 is 1, whereas the delays of the second and third pulse responses IA2 and IA3 are 2 and 3, respectively. As is evident from FIG. 2B, the three pulse responses now will be arranged in a temporally offset manner while taking into account their individual delays. One may see that the pulse response IA3 is offset by two delay units relative to the pulse response IA1. The example shown in FIG. 2A describes the case in which the times of occurrence T1, Ti are identical, specifically relating to the time T=0. However, for example, if the time of occurrence T3 were offset back by three time units relative to the times of occurrence of the other two pulse responses, the pulse response IA3 would not start until the time 6 in the upper partial image of FIG. 2B.

Subsequently, the individual pulse responses which are arranged in a temporally correct manner are summed up to obtain the result, i.e. the combination pulse response information. In particular, values of the individual pulse responses which are located at identical points in time are added up and are possibly subjected to weighting using a weighting factor prior to or following the addition.

Figure 2B:
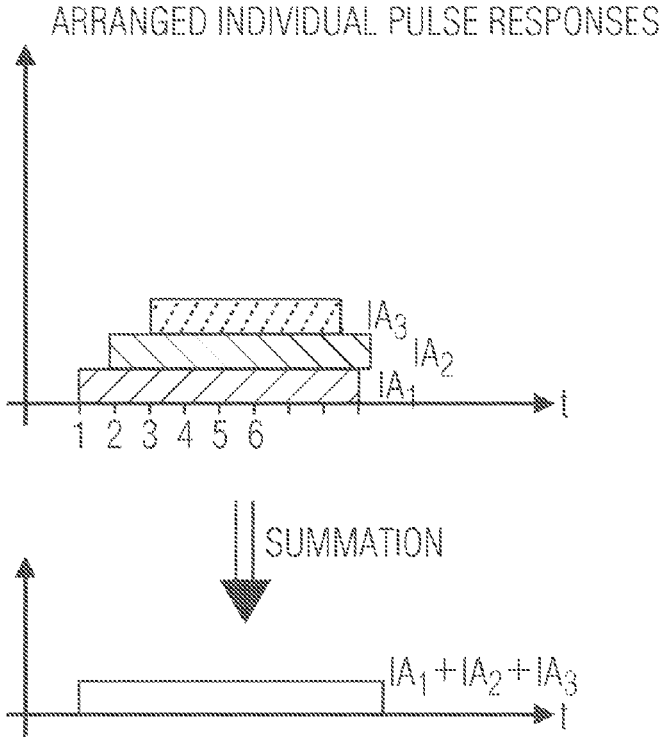
FIG. 2B shows a schematic representation of the individual pulse responses which are arranged, in terms of time, relative to the delays, and of a combined pulse response generated by summation.

It shall be noted here that the representation in FIGS. 2*a* and 2*b* is only schematic. For example, the temporally correct arrangement need not necessarily be directly performed within a register memory of a processor before the summation takes place. Instead, it is advantageous to subject the individual pulse responses to temporal offset operations in accordance with the delays and the necessary times of occurrence, and to do so immediately prior to the addition.

Figure 2C:
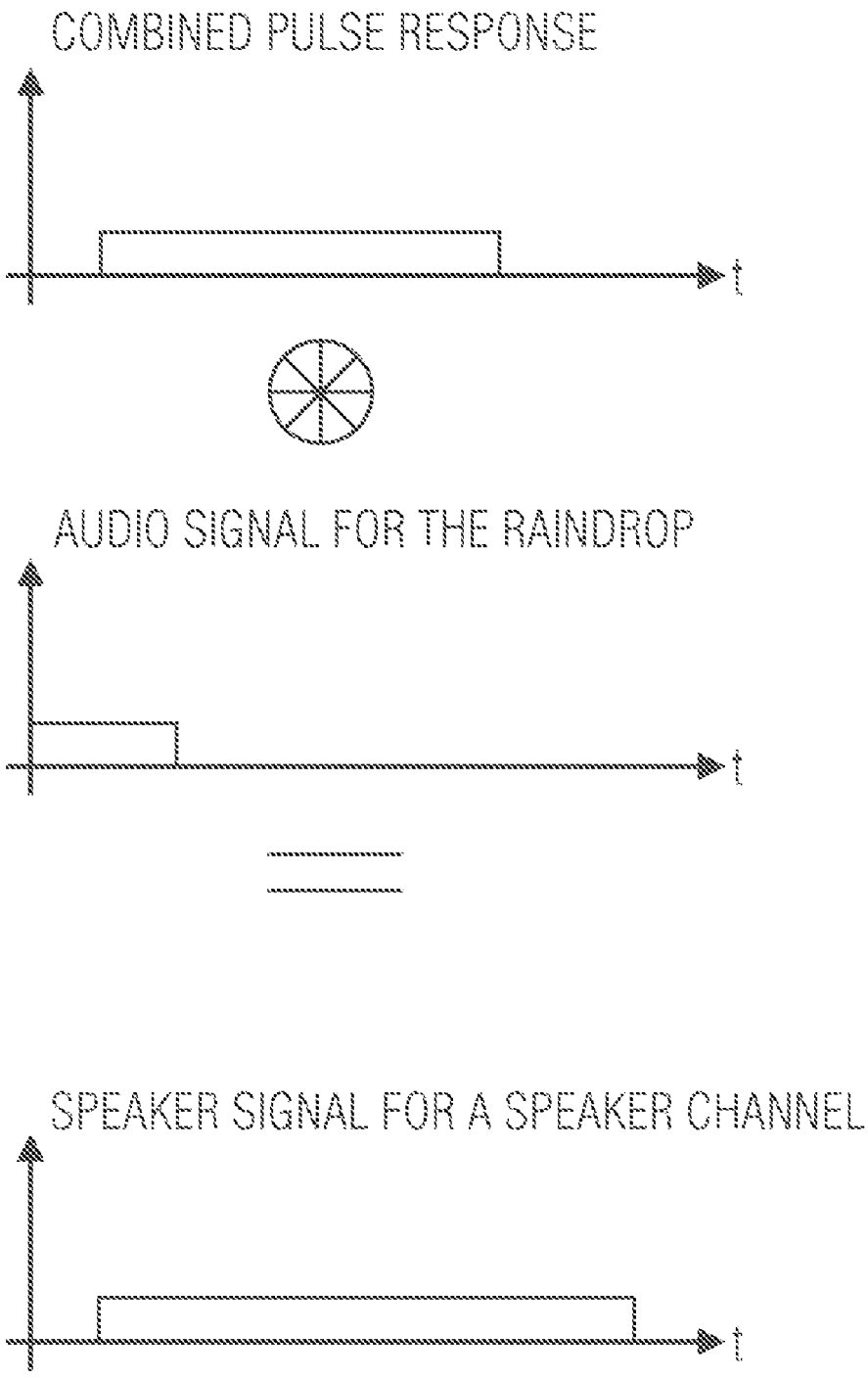
FIG. 2C shows a schematic representation of the filtering of the audio signal for the audio source using a filter represented by the combined pulse response so as to obtain the speaker signal for a speaker channel.

Finally, FIG. 2C shows the operation performed by the filter 21 having an adjustable pulse response. In particular, the combined pulse response is convoluted, in the top sub-image of FIG. 2C, with the audio signal in the medium sub-image of FIG. 2C to finally obtain the speaker signal for a speaker channel. The convolution may occur as a convolution either directly within the time domain. Alternatively, both the pulse response and the audio signal may be transformed to the frequency domain, so that the convolution becomes a multiplication of the frequency domain representation of the audio signal, and of the frequency domain representation of the combined pulse response, which is now the transmission function.

Depending on the implementation, other convolution algorithms which are typically block-oriented, such as FFT convolution, may be employed. In this context, it is favorable to generate the combination pulse response in a block-wise manner. For example, one may see that the portion of the combined pulse response of times 1 to 4 may already readily be used at the same time as later portions belonging to later points in time are being calculated. Thus it is ensured that the inventive concept may be implemented at a relatively small delay and thus with a limited amount of buffer memory.

Reference shall be made below, with regard to FIG. 3, to advantageous implementations of the inventive concept, particularly to the generation of the speaker signals for not only one speaker channel, but for many speaker channels, it being pointed out that in principle, the generation of a speaker signal for a speaker channel is performed in the same manner for all other speaker channels.

Figure 3:
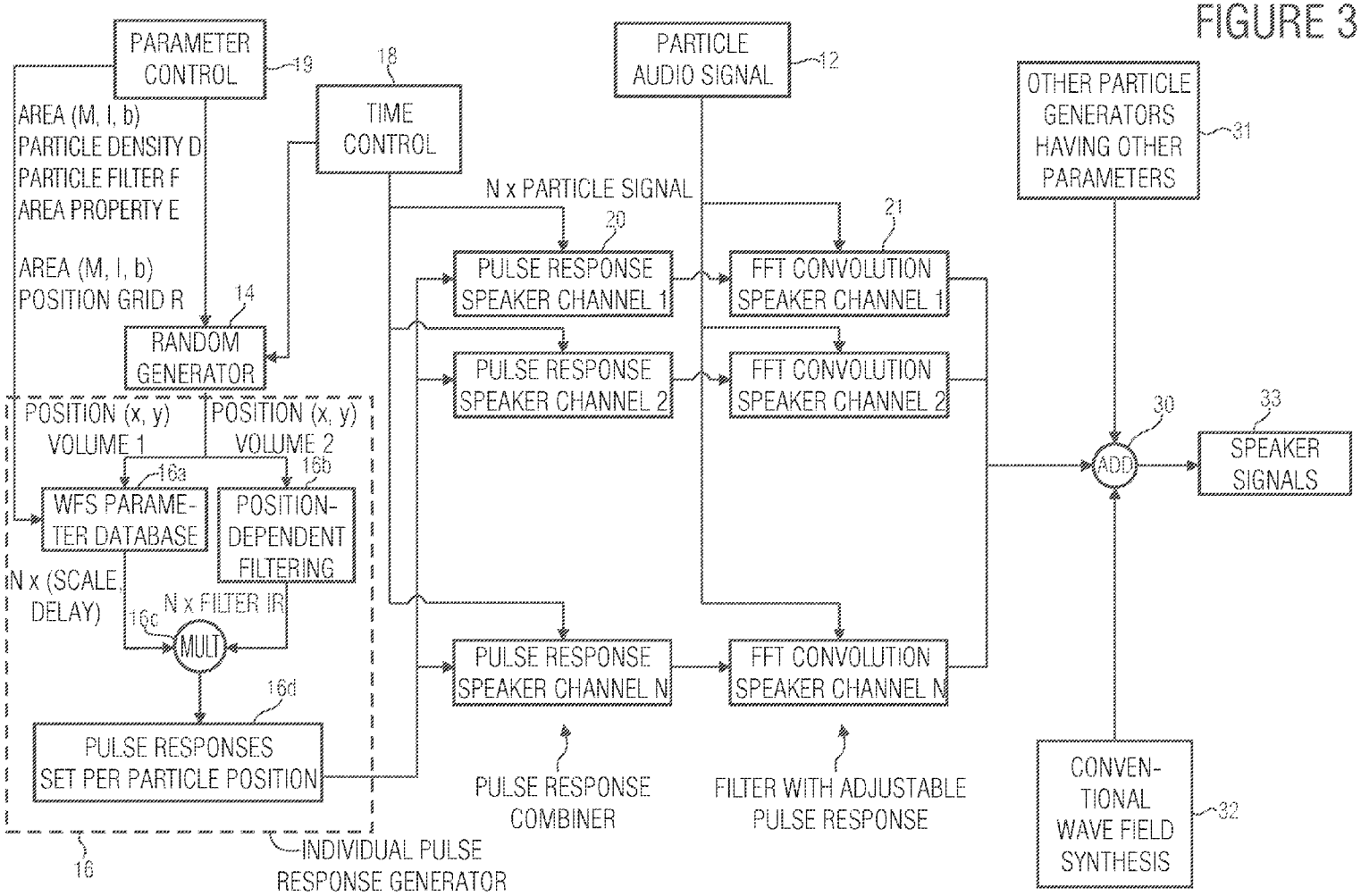
FIG. 3 shows a block diagram of the inventive device in accordance with an advantageous embodiment of the present invention.

In the advantageous embodiment of the invention shown in FIG. 3, the parameter control 19 is configured to provide area information as a concrete area, advantageously in a rectangular shape. For example, a length l and a width b of an area as well as a center M of this area are provided. Thus, the area within the reproduction space, onto which the raindrops are to impinge, for example, may be indicated but only to the effect that either the entire reproduction space or only part of the reproduction environment is to be "rained on" with rain. In addition, a particle density is indicated, i.e. the number of particles per time window. In addition, a particle filter control signal F is provided which is used in the block, to be described later on, of the position-dependent filtering to generate a decorrelation between the raindrops. This results in that the overall impression does not become synthetic, but becomes realistic, especially since, evidently, not all raindrops sound the same, but deviate from one another within certain limits in terms of the sounds they make. However, in accordance with the invention, only one particle audio signal is provided for a specific time duration. However, the particle filter ensures that differences in sound occur among these essentially identical raindrops.

Finally, the parameter control 19 provides area properties E which are also employed in the position-dependent filtering, for example to signal that a raindrop impinges on a wooden surface, on a sheet-metal surface or on a water surface, i.e. on types of matter having different properties.

The random generator 14 corresponds to the position generator 14 of FIG. 1 and advantageously includes a real or pseudo random generator, just like the time control 18, to generate both the individual positions and the individual moments in time in a manner which is controlled by the area parameter and the density parameter. Depending on a position x, y generated by the random generator, a wave field synthesis parameter database is entered in the advantageous embodiment, shown in FIG. 3, of the present invention. In this wave field synthesis parameter database, an input value, namely position x, y, has a set of individual pulse response information associated with it, each individual pulse response information of this set of individual pulse response information being intended for a speaker channel. A scaling value (scale) and a delay are now provided for each of a number of N speakers, or for each of a number of N speaker groups. This pair of scale and delay represents the simplest form of individual pulse response information provided by the individual pulse response generator 16. The pulse response, which is represented by the scale and the delay, has only one single value, namely at the point in time given by the delay, and comprising an amplitude given by the scale.

However, it is advantageous to use a further table within the block (position-dependent filtering 16*b*) in addition to the access to the wave field synthesis parameter database 16*a*. Depending on the position x, y, a "correct" pulse response comprising more than one value and being able to model the timbre of the drop is output. For example, a drop falling on a tin roof will get a different pulse response (IR) within block 16*b* than a drop which, due to its position, does not fall on a tin roof, but on a water surface, for example. By the block of "position-dependent filtering" 16*b*, a set of N filter pulse responses (filter IR) is thus output, specifically, again, for each of the individual speakers. A multiplication per speaker channel then takes place in a multiplication block 16*c*. In particular, the pulse response represented by scale and delay is multiplied by the filter pulse response generated for the same speaker channel in block 16*b*. Once this multiplication has been performed for each of the N speaker channels, one obtains a set of N individual pulse responses for each particle position, i.e. for each raindrop, as is represented in a block 16*d*.

In addition, further functionalities may be implemented by block 16*b*. In addition to the provision of a position-dependent filter which takes into account the timbre of the raindrop, a further or combined pulse response may be additionally provided, by means of which the sound of a raindrop is slightly modified depending on the position, but randomly generated. In this manner, it is ensured that not all of the raindrops falling on a tin roof will sound exactly the same, but that each, or at least some of the raindrops, will sound different, so as to therefore do more justice to nature, where all raindrops do not sound identical (but similar).

In addition, it is advantageous to also take into account the low-pass artifact of the wave field synthesis in the pulse response provided by block 16*b*. One has found that the wave field synthesis algorithm results in that a low-pass filtering takes place which may be perceived by a listener. It is therefore advantageous to perform a pre-distortion as early as in the filter pulse response, such that the high frequencies will be advantageous, such that the pre-distortion will be compensated as precisely as possible when the low-pass effect of the wave field synthesis algorithm occurs.

This procedure is repeated for other particle positions for those pulse responses for the N speakers per particle position which have been determined in block 16*d*, so that, as was already set forth with reference to FIG. 2*a*, for each particle position there is a filter pulse response which is already scaled with the scale provided by block 16*a*, and which has the delay associated with it, as was already set forth with reference to FIG. 2*a*.

By the pulse response combiner 20, which is to be provided for each speaker channel, the combination pulse response is calculated for each speaker channel and is used for each speaker channel for filtering within the filter 21.

Figure 4:
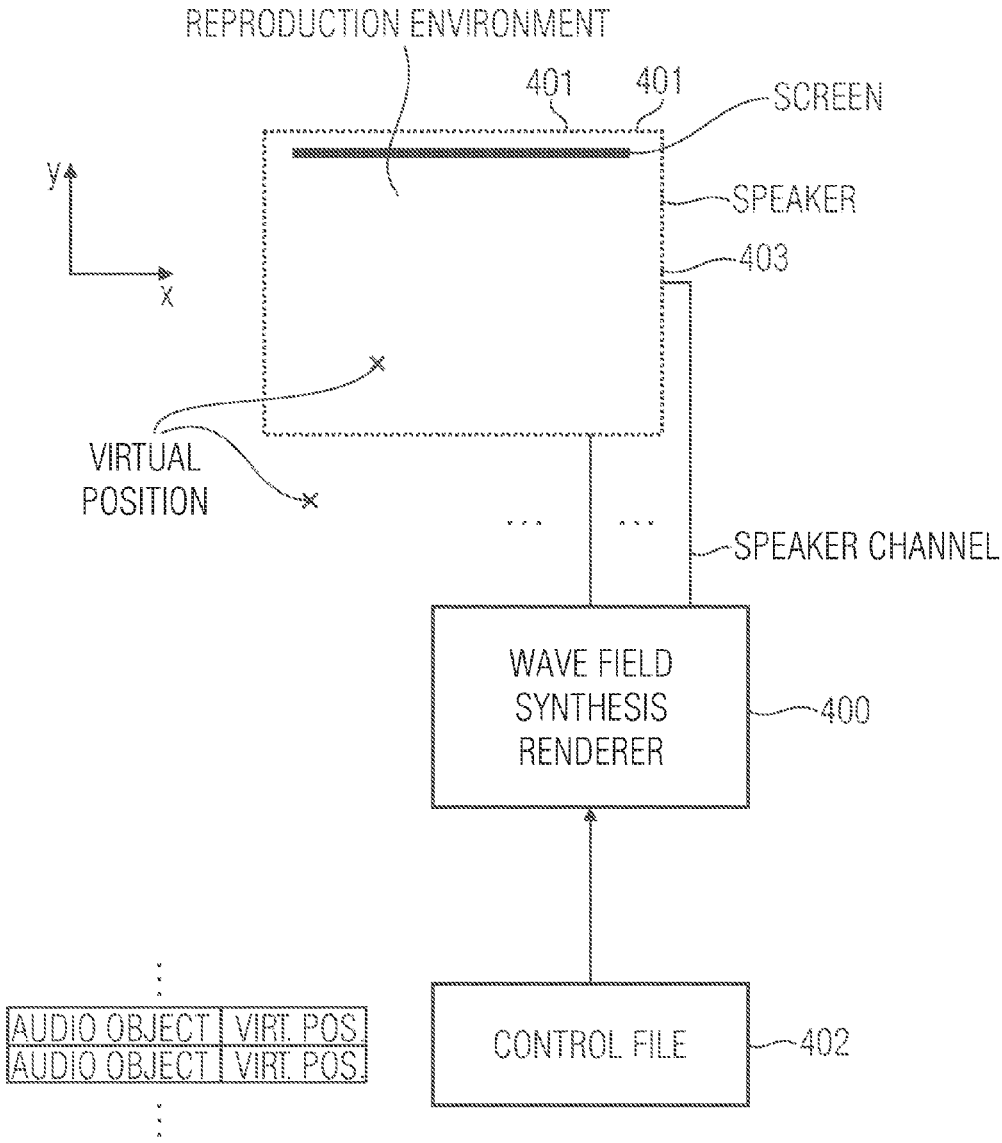
FIG. 4 shows a fundamental block diagram of a typical wave field synthesis scenario.

The speaker signal for this speaker channel will then be present at the output of each speaker channel, for example of speaker channel 1 (block 21 in FIG. 3). As far as that goes, the representation of an adder 30 which is shown in FIG. 3 is to be taken symbolically. Actually, there are N adders to combine, for each speaker channel, the speaker signal calculated by a block 21 with a corresponding speaker signal of a different particle generator 31 having different properties, and naturally also with a speaker signal for an audio object as is represented by the control file 402 of FIG. 4. Such a speaker signal is generated by a conventional wave field synthesis arrangement 32. The conventional wave field synthesis device 32 could include, for example, a renderer 400 and a control file 402 as are depicted in FIG. 4. Following an addition of the individual speaker signals for a speaker channel, the resulting speaker signal for this speaker channel (block 33) will be present at the output of an adder 30, which speaker signal may then be conveyed to a speaker, e.g. speaker 403 of FIG. 4.

Using the parameters of the parameter control, the random generator 14 thus generates positions where particles are to occur. The frequency of the occurring particles is controlled by the connected time control 18. The time control 18 serves as a time reference for the random generator 14 and the pulse response generators 16*a*, 16*b*. Using the particle position from the random generator 14, the wave field synthesis parameters of 'scale' and 'delay' are created, on the one hand, for each speaker from a pre-calculated database (16*a*). On the other hand, a filter pulse response is generated in accordance with the position of the particle, the generation of the filter pulse response in block 16*b* being optional. The filter pulse response (FIR filter) and the scale are multiplied vectorially in block 16*c*. Taking into account the delay, the multiplied, i.e. scaled, filter pulse response is then "inserted", as it were, into the pulse response of the pulse response generator 20.

It shall be noted that this insertion into the pulse response of the pulse response generator is conducted both on the basis of the delay generated by the block 16*a* and based on a time of occurrence of the particle, such as the starting time, a mean time, or an end time, at which, e.g., a raindrop is "active".

Alternatively, the filter pulse response provided by the block 16*b* may also be processed directly with regard to the delay. Since the pulse response provided by block 16*a* has only one value, this processing simply results in that the pulse response output by block 16*b* will be offset by the value of the delay. This offset may either occur prior to the insertion in block 20, or the insertion in block 20 may occur while taking into account this delay, which is advantageous for reasons concerning the computing time.

In an advantageous embodiment of the present invention, the pulse response generator 20 is a time buffer configured to sum up the generated pulse responses of the particles, including all the delays.

The time control is further configured to pass on blocks having a predetermined block length of this time buffer to the FFT convolution in block 21 for each speaker channel. It is advantageous to use an FFT convolution, i.e. a fast convolution based on the fast Fourier transform, for the filtering by means of the filter 21.

The FFT convolution convolutes the constantly changing pulse responses with a particle which does not change in terms of time, namely with the audio signal provided from the block of particle audio signal 12. Thus, a particle signal results within the FFT convolution at the respective moment in time for each pulse from the pulse response generator. Since the FFT convolution is a block-oriented convolution, the particle audio signal may be switched over with each block. Here it is advantageous to make a compromise between the computing power needed, on the one hand, and the rate of change of the particle audio signal, on the other hand. The computing power of the FFT convolution decreases as block sizes increase; on the other hand, the particle audio signal may only be switched over with a relatively large delay, namely one block. A switchover between particle audio signals would be reasonable, for example, when a switchover is made from snow to rain, or when a switchover is made from rain to hail, or when a switchover is made, for example, from a light rain having "small" drops to a harder rain having "large" drops.

The output signals of the FFT convolutions for each speaker channel may be summed up with the standard speaker signals, as is shown at 30 in FIG. 3, and evidently also with other particle generators for each individual speaker channel in each case, so as to finally obtain the resulting speaker signal for a speaker channel.

The inventive concept is advantageous to the effect that a realistic spatial reproduction of frequently occurring sound objects over large audible ranges in real time may be achieved by means of a calculation method which is not very computationally intensive.

In addition, one particle audio signal may be replicated per algorithm described. Because of the built-in position-dependent filtering, it is further advantageous to also achieve an alienation of the particle. In addition, different algorithms may be used in parallel to generate different particles, so that an efficient and realistic sound scenario is created.

The inventive concept may be employed both as an effector for wave field synthesis systems and for any surround reproduction systems.

Unlike the above-described two-dimensional system, for the three-dimensional system it is advantageous to replace the area information by volume information. Positions will then be three-dimensional spatial positions. The particle density will then become a quantity of particle/(time·volume).

Moreover, the inventive concept is not limited to wave field systems of a two-dimensional nature. Real three-dimensional systems, such as ambisonics, may be controlled with modified coefficients (scale, delay, filter pulse response) within the individual pulse response generator 16 (FIG. 1). Two-dimensional "half" systems such as all of the X.Y formats may also be controlled via modified coefficients.

The FFT convolution within the filter device having an adjustable pulse response 21 (FIG. 1) may be configured to be favorable in terms of computing expense using any existing optimization methods (half the block length, block-wise decomposition of the pulse response). Reference shall be made, for example, to William H. Press, et. al., "Numerical Receipts in C", 1998, Cambridge University Press.

Depending on the circumstances, the inventive method may be implemented in hardware or in software. Implementation may be on a digital storage medium, in particular a disc or CD with electronically readable control signals which may interact with a programmable computer system such that the method is performed. Generally, the invention thus also consists in a computer program product with a program code, stored on a machine-readable carrier, for performing the method, when the computer program product runs on a computer. In other words, the invention may thus be realized as a computer program having a program code for performing the method, when the computer program runs on a computer.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. An apparatus for generating a speaker signal for a speaker channel associated with a speaker which may be mounted, in a reproduction environment, at a speaker position of a plurality of speaker positions, the apparatus comprising:

a source for providing an audio signal for an audio source which is to occur at different positions and at different times within an audio scene;

a position generator for providing a plurality of positions where the audio source is to occur;

a time generator for providing times of occurrence when the audio source is to occur, a time being associated with a position;

an individual pulse response generator for generating individual pulse response information for each position of the plurality of positions for a speaker channel on the basis of the positions and information on the speaker channel;

a pulse response combiner for combining the individual pulse response information in accordance with the times of occurrence to acquire combination pulse response information for the speaker channel; and a filter for filtering the audio signal using the combination pulse response information to acquire a speaker signal for the speaker channel, which signal represents the audio source which occurs at different positions and at different times within the audio scene.

2. The apparatus as claimed in claim 1, wherein the position generator comprises a random generator to provide random positions from a supply of possible positions.

3. The apparatus as claimed in claim 1, wherein the time generator is adapted to adjust the times of occurrence as a function of a predefined particle density, so that a number of times of occurrence which is predefined by the particle density will be provided within a time window.

4. The apparatus as claimed in claim 3, wherein the individual pulse response generator is adapted to access a predetermined table and to determine the individual pulse response information as a function of the position and the speaker channel.

5. The apparatus as claimed in claim 1, wherein the individual pulse response generator is adapted to provide a scaling factor and a delay which depend on the position.

6. The apparatus as claimed in claim 1, wherein the individual pulse response generator is adapted to determine a scaling factor and a delay on the basis of a position, to determine an additional pulse response associated with an occurrence of the audio source, and to weight the additional pulse response with the scaling factor so as to acquire the individual pulse response information.

7. The apparatus as claimed in claim 1, wherein the pulse response combiner is adapted to add up the individual pulse response information, in a temporally offset manner, as a function of the times of occurrence so as to acquire combination pulse response information.

8. The apparatus as claimed in claim 6, wherein the pulse response combiner is adapted to add up the individual pulse response information, in a temporally offset manner, as a function of the times of occurrence and the delay so as to acquire combination pulse response information.

9. The apparatus as claimed in claim 6, wherein the individual pulse response generator is adapted to select the additional pulse response as a function of the position.

10. The apparatus as claimed in claim 1, wherein the source for providing is adapted to provide an audio signal for an audio source which occurs within an audio scene in a random or quasi-random manner.

11. The apparatus as claimed in claim 1, further comprising:

a generator for generating a component signal for an audio object on the basis of a virtual position, of an audio signal associated with the audio source, and of information on the speaker channel; and a beat oscillator for superimposing the component signal and the speaker signal to acquire an overall speaker signal for the speaker channel.

12. A method for generating a speaker signal for a speaker channel associated with a speaker which may be mounted, in a reproduction environment, at a speaker position of a plurality of speaker positions, the method comprising:

providing an audio signal for an audio source which is to occur at different positions and at different times within an audio scene;

providing a plurality of positions where the audio source is to occur;

providing times of occurrence when the audio source is to occur, a time being associated with a position;

generating individual pulse response information for each position of the plurality of positions for a speaker channel on the basis of the positions and information on the speaker channel;

combining the individual pulse response information in accordance with the times of occurrence to acquire combination pulse response information for the speaker channel; and filtering the audio signal using the combination pulse response information to acquire a speaker signal for the speaker channel, which signal represents the audio source which occurs at different positions and at different times within the audio scene.

13. A non-transitory computer readable storage medium on which is stored a computer program for causing a computer to perform a method for generating a speaker signal for a speaker channel associated with a speaker which may be mounted, in a reproduction environment, at a speaker position of a plurality of speaker positions, the method comprising:

providing an audio signal for an audio source which is to occur at different positions and at different times within an audio scene;

providing a plurality of positions where the audio source is to occur;

providing times of occurrence when the audio source is to occur, a time being associated with a position;

generating individual pulse response information for each position of the plurality of positions for a speaker channel on the basis of the positions and information on the speaker channel;

combining the individual pulse response information in accordance with the times of occurrence to acquire combination pulse response information for the speaker channel; and filtering the audio signal using the combination pulse response information to acquire a speaker signal for the speaker channel, which signal represents the audio source which occurs at different positions and at different times within the audio scene, when the computer program runs on a computer.

* * * * *